US006622885B1

(12) United States Patent
Erman

(10) Patent No.: US 6,622,885 B1
(45) Date of Patent: Sep. 23, 2003

(54) ARM MOUNTED TRANSPORTING TRAY FOR FOOD CONTAINERS

(76) Inventor: Yury M. Erman, 4933 Calle Robleda, Agoura Hills, CA (US) 91301

( * ) Notice: Subject to any disclaimer, the term of this patent is extended or adjusted under 35 U.S.C. 154(b) by 2 days.

(21) Appl. No.: 10/096,652

(22) Filed: Mar. 12, 2002

Related U.S. Application Data

(63) Continuation-in-part of application No. 09/972,624, filed on Oct. 9, 2001, now abandoned.

(51) Int. Cl.[7] ..... B65D 1/34
(52) U.S. Cl. ..... 220/571; 220/574
(58) Field of Search ..... 220/571, 574

(56) References Cited

U.S. PATENT DOCUMENTS 5,339,676 A * 8/1994 Johnson ..... 73/40
5,515,998 A * 5/1996 Wang ..... 220/710
5,634,568 A * 6/1997 Wawrzyniak ..... 220/510
5,662,240 A * 9/1997 Norris ..... 220/574
5,908,133 A * 6/1999 Luburic et al. ..... 220/572
5,960,982 A * 10/1999 Perlis et al. ..... 220/574
6,079,587 A * 6/2000 Vogt ..... 220/571
6,092,689 A * 7/2000 Bennett ..... 220/729

* cited by examiner

*Primary Examiner*—Joseph Moy
(74) *Attorney, Agent, or Firm*—Jack C. Munro

(57) ABSTRACT

An arm mounted transporting tray for food containers which takes the form of essentially a flat base which has a raised lip around its peripheral edge. Within the flat base is located a groove arrangement which will conduct any spilled liquids to an opening formed within the base which will then be deposited within an internal reservoir that is formed within a graspable handle that is mounted on the undersurface of the base. Also mounted on the undersurface of the base is an upper arm engagement which keeps the tray correctly aligned on the user's arm.

9 Claims, 3 Drawing Sheets

ARM MOUNTED TRANSPORTING TRAY FOR FOOD CONTAINERS

This application is a continuation-in-part of U.S. patent application Ser. No. 09/972,624, filed Oct. 9, 2001, entitled ARM MOUNTED TRANSPORTING TRAY FOR FOOD CONTAINERS, by the present inventor now abandoned.

BACKGROUND OF THE INVENTION

1. Field of the Invention

This invention relates to a tray that is to be mounted on a single arm of a user with food containers, such as dishes, plates and beverage containers, glasses, cups and bottles are to be located on the upper surface of the tray to facilitate transportability of these containers to a serving location.

2. Description of the Related Art

Waiters and waitresses within restaurants deliver ordered food and beverages to patrons. Typically, the food and beverages are in the form of dishes, plates, cups, glasses and bottles. One of the functions of the waiter or waitress is to pick up the food from a kitchen station and then transport that food to the table or other serving location where the patron 10 is located. Frequently, the waiter or waitress, in order to minimize the amount of walking between the kitchen location and the patron location, will place and balance two, three or four food containing plates or dishes on a forearm of the waiter or waitress. This leaves the hands free of the waiter or waitress in order to be used to carry other food containing dishes.

The human forearm is not designed as a surface that easily supports food containing dishes. Therefore, it is relatively common to have these dishes that are balanced on one's forearm to fall to the floor breaking requiring the reordering of the food and obtaining a new serving. Besides being costly, this is time consuming, embarrassing and produces an unsightly mess that needs to be cleaned up by restaurant personnel. To avoid these disadvantages, it would be desirable to create some type of a serving tray which could be mounted on a forearm of a waiter or waitress which could be used to support and transport the food and beverage containing dishes to a serving location within a restaurant which would minimize the possibility of spilling any dish as well as provides additional space facilitating the transportability of multiple food and beverage containers.

SUMMARY OF THE INVENTION

The basic embodiment of the present invention comprises an arm mounted tray for food and beverage containers which has a base which has an upper surface and a lower surface. The upper surface has a peripheral edge in the form of a continuous raised lip which surrounds the upper surface. The upper surface may be planar or slightly V-shaped. The V-shape is to function to collect and drain any spilled liquid to one or more openings formed within the upper surface of the base. Each opening connects to a separate internal reservoir formed within either a graspable handle or leg members which are mounted on the lower surface of the base. The leg members and handle facilitate placing of the tray on a supportive surface as well as functioning to positioning the tray onto the user's forearm.

A further embodiment of the present invention is where the basic embodiment is modified by the upper surface of the tray including a drainage groove arrangement including a longitudinal groove.

A further embodiment of the present invention is where the longitudinal groove is centrally located relative to the upper surface.

A further embodiment of the present invention is where the arm engagement comprises a clamping device located directly adjacent the aft end of the tray.

A further embodiment of the present invention is where the basic embodiment is modified by the graspable handle being located directly adjacent the fore end of the tray.

A further embodiment of the present invention is where the clamping device is adjustable.

A further embodiment of the present invention is where the groove arrangement connects to an opening formed within the upper surface of the tray.

A further embodiment of the present invention is where the basic embodiment is modified by the arm engagement comprising a pair of spaced apart leg members.

A further embodiment of the present invention is where the leg members are identical and are also identical to the graspable handle.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
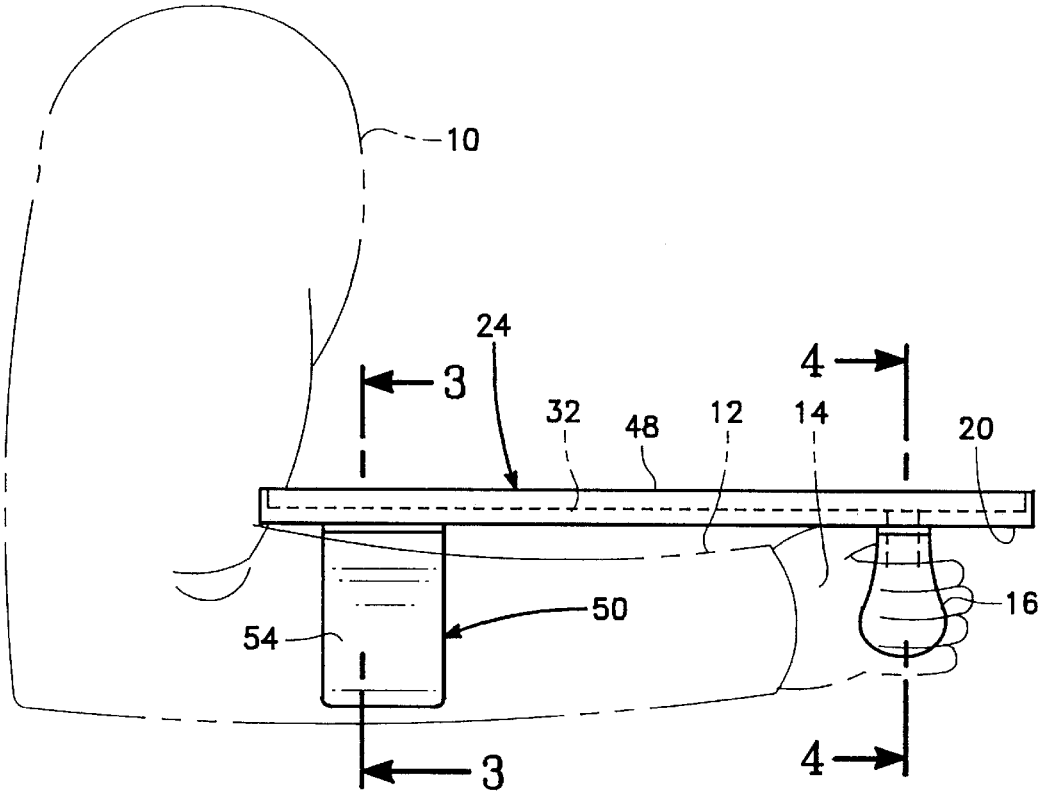
FIG. 1 is a side elevational view of a first embodiment of arm mounted transportation tray for food containers showing such typically installed on a forearm of a user.
Figure 2:
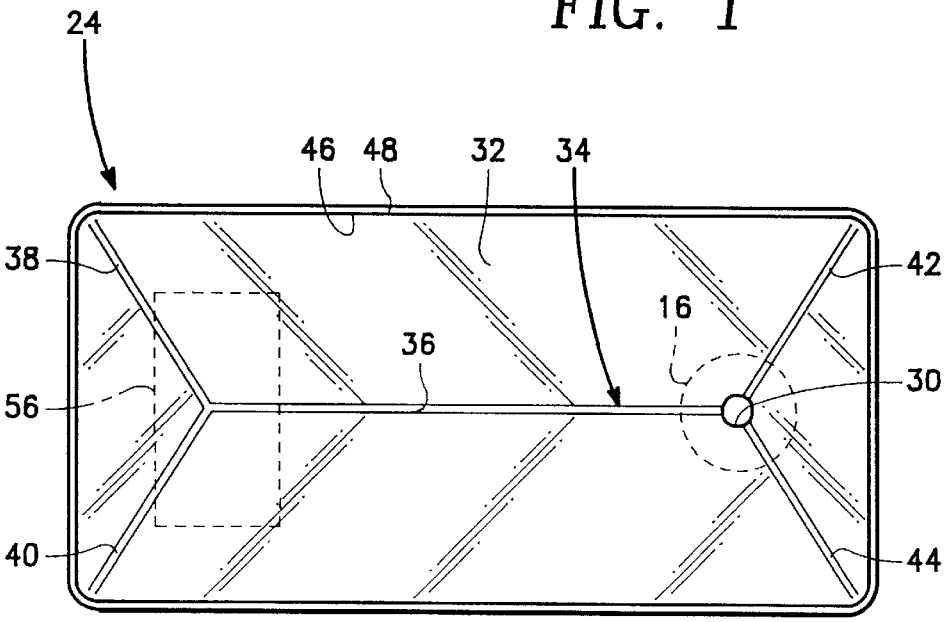
FIG. 2 is a top plan view of the first embodiment of transportation tray for food containers.
Figure 4:
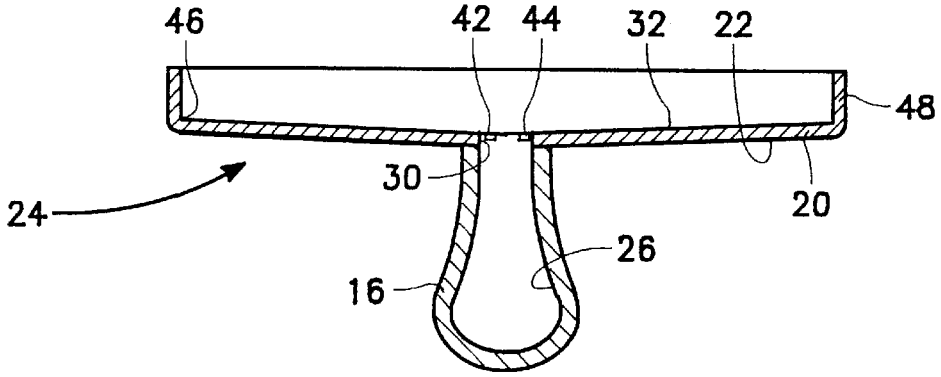
FIG. 4 is a cross-sectional view through the first embodiment of tray of the present invention and also through the graspable handle mounted on the tray of the present invention taken along line 4—4 of FIG. 1.
Figure 5:
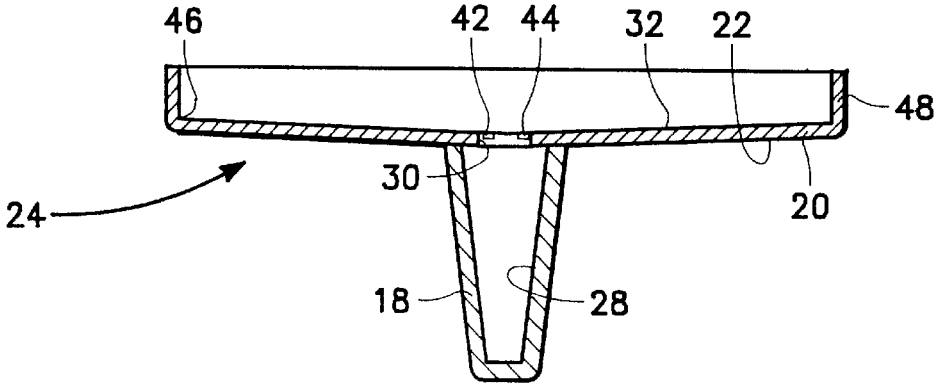
FIG. 5 is a cross-sectional view similar to FIG. 4 but of a modified form of graspable handle.

Referring particularly to the drawings, there is shown in phantom lines in FIG. 1 an upper arm 10, a forearm 12 and a hand 14 of a user. The user's hand 14 is to function to grasp a handle 16. The handle 16 could take the form of a bulbous shape, as shown in FIG. 4. However, it is considered to be within the scope of this invention that the handle 16 could be modified to assume a smooth walled tapered configuration of handle 18, as shown in FIG. 5. Any exterior configuration of handle could be utilized without departing from the inventive concept of the present invention.

The handle 16 is fixedly mounted onto a lower surface 22 of a transporting tray 24. The handle 16 is basically hollow forming an internal chamber 26. Similarly, the handle 18 is basically hollow forming an internal chamber 28. Connecting with internal chamber 26 or 28 is an opening 30 formed within the base 22. The opening 30 connects between the lower surface 20 and the upper surface 32 of the base 22.

Formed within the upper surface 32 of the base 22 is a groove arrangement 34. The groove arrangement 34 comprises a single, centrally located, longitudinal, drainage groove 36 with a pair of feeding grooves 38 and 40. The opposite end of the longitudinal, drainage groove 36 connects with the opening 30. Also connecting with the opening 30 are another pair of feeding grooves 42 and 44. The upper surface 32 is formed to be slightly inclined (not planar). The inclination of the upper surface 32 is such that the longitudinal, drainage groove 36 is at the lowest elevation. If, per chance, a beverage spills on the upper surface 32, the liquid of the beverage will be automatically funneled by the feeding grooves 38 and 40 to the longitudinal, drainage groove 36 and then through opening 30 to within the internal chamber 26 or 28. Also, feeding grooves 42 and 44 will function to feed any liquid into the opening 30 in order to remove most of the spilled liquid off of the upper surface 32 of the tray 24 to minimize contamination with any dishes on the upper surface 32. At an appropriate time, it is to be understood that the upper surface 32 is to be cleaned of any spilled beverage with the internal chamber 26 or 28 being appropriately rinsed out so as to remove any accumulated beverage.

The upper surface 32 has a peripheral edge 46. Attached at the peripheral edge 46 is a continuous raised lip 48. The raised lip 48 will normally be no more than one-half inch in height and functions to completely enclose the upper surface 32. The function of the raised lip 48 is to confine any spilt beverage on the upper surface 32 and also to assist in keeping any food or beverage container in place on the tray 24 to prevent such from falling from the tray 24.

Figure 3:
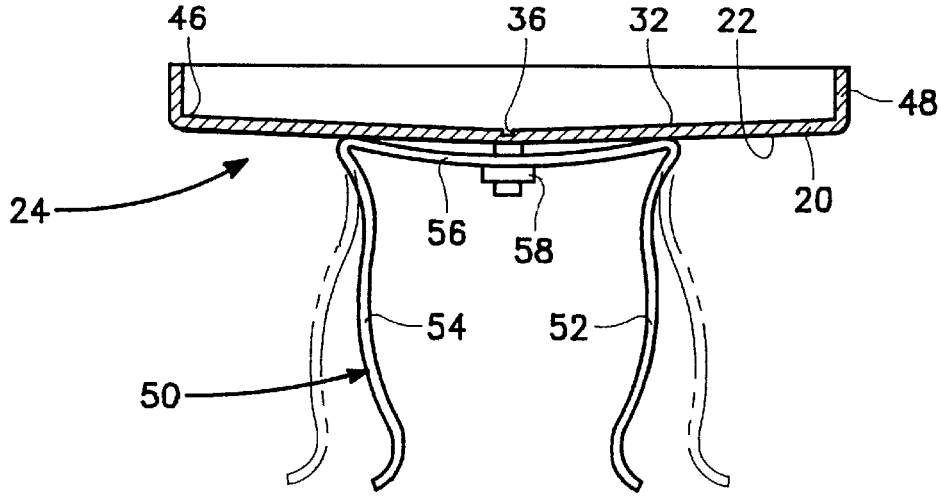
FIG. 3 is a cross-sectional view through the first embodiment tray of the present invention and also through the clamp that is included in conjunction with the first embodiment of tray of the present invention taken along line 3—3 of FIG. 1.

To have the tray 24 maintain its established position on the user's forearm 12, there is provided a clamp 50 which is basically bifurcated forming a pair of spaced apart arms 52 and 54 which are integrally mounted on an apex section 56. The apex section 56 is fixedly secured to the lower surface 20 of the base 22 by means of an appropriate fastener 58. The arms 52 and 54 will normally assume the at-rest position which is shown in dotted lines in FIG. 3. However, the arms 52 and 54 are each capable of springing in an outward direction so as to be adjustable to compensate for different sizes of forearms 12. This springing or adjustable action is shown in phantom lines in FIG. 3. It is considered to be within the scope of this invention that the clamp 50 could be constructed in a manner different in order to be adjustable. It is also considered to be within the scope of this invention that the clamp 50 could take different forms, for example an attaching strap.

The use of the tray 24 of the present invention is to have the user first pick up the tray 24, grasp the graspable handle 16 or 18 and place the clamp 50 in position with the user's forearm 12 located between the arms 52 and 54. The user is to then place on the upper surface 32 the desired amount of food containing containers and beverage containers. The user is to then transport these dishes and beverage containers to an appropriate patron serving location whereby these dishes and beverage containers are then removed from the upper surface 32 and placed on a table or counter at which location is the person being served.

Figure 6:
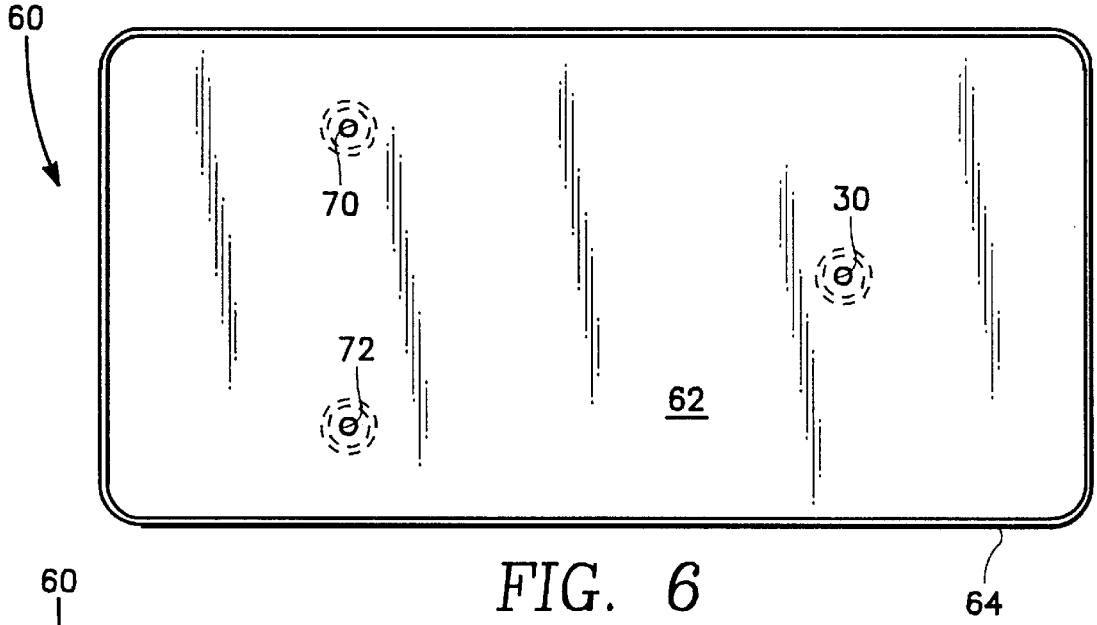
FIG. 6 is a top plan view of a second embodiment of tray of this invention which includes the modified form of graspable handle shown in FIG. 5.
Figure 7:
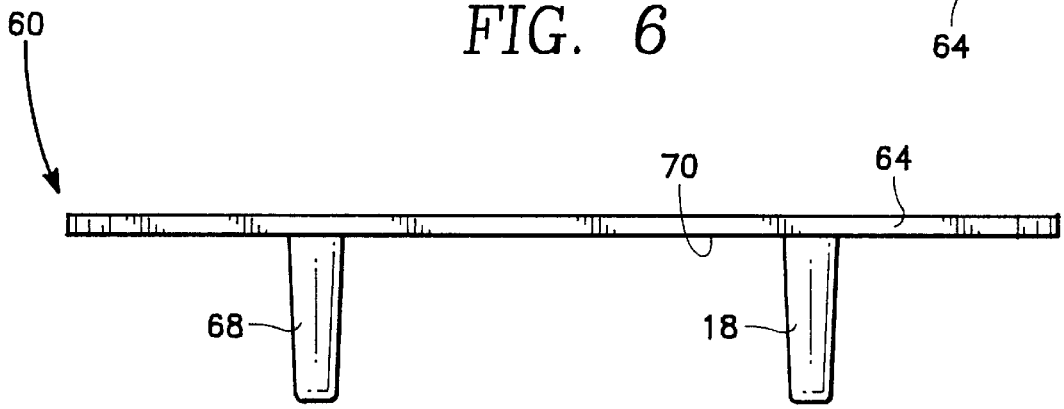
FIG. 7 is a side elevational view of the second embodiment of this invention.
Figure 8:
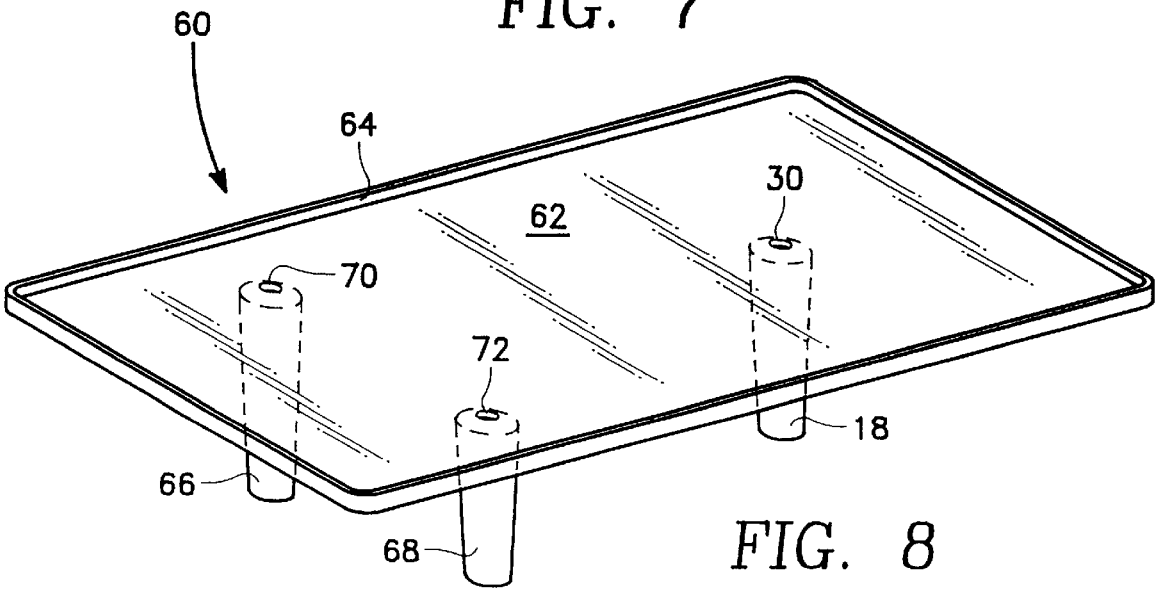
FIG. 8 is a perspective view of the second embodiment of this invention.

Referring particularly to FIGS. 6, 7 and 8 of the drawings, there is shown the second embodiment 60 of tray of this invention. Second embodiment 60 has a planar surface 62 which is enclosed by a raised lip 64. The surface 62 could be planar or could include the groove arrangement and the slight V-shape, as was shown in relation to the first embodiment 24 of this invention. Instead of the clamp 50, there is used instead a pair of leg members 66 and 68 which are fixedly mounted onto the lower surface 70 of the tray 60. Each of the leg members 60 and 66 are identical and are also identical to the graspable handle 68. However, the leg members 66 and 68 are located so that when the user grasps the handle 18 that the user's forearm will be located between the leg members 66 and 68. As a result, the leg members 66 and 68 function to restrain the tray 60 relative to the user's arm and keep the tray 60 from dislodging from the user's arm. Leg member 66 also includes an internal chamber with through opening 70 being open to the upper surface 62 of the tray to provide access to the internal chamber. In a similar manner, the leg member 68 includes a through opening 72 which connects to an internal chamber formed within the leg member 68. The result is the leg members 66 and 68 can also function to retain any spilled liquids the same as the graspable handle 18.

The leg members 66 and 68 and the graspable handle 18 also function to permit the second embodiment 60 to be set on a supportive surface, such as a table, and rest on the supporting surface in a level configuration. It is to be noted that a multiple number of the trays 60 can be stacked relative to each other with leg members 66 and 68 nesting inside of a similar pair of leg members 66 and 68 of another tray. The same is true for the graspable handle 18 of different trays.

What is claimed is:

1. An arm mounted transporting tray for food and beverage containers comprising:

a base having an upper surface and a lower surface, said upper surface having a peripheral edge, a continuous raised lip located at said peripheral edge which surrounds said upper surface, said upper surface being substantially planar being slightly inclined towards a longitudinal groove;

a graspable handle mounted on said lower surface, an opening formed in said upper surface, said graspable handle having an internal reservoir adapted to collect and retain liquid which falls on said upper surface and is caused to flow by said groove arrangement through said opening into said internal reservoir; and an arm engagement mounted on said lower surface, said arm engagement being spaced from said graspable handle, said arm engagement adapted to connect with a forearm of a user, whereby a user of said tray can place food containing dishes and beverage containers on said upper surface which will facilitate transportability by the user to a serving location.

2. The arm mounting tray as defined in claim 1 wherein:

said upper surface having a drainage groove arrangement which includes a longitudinal groove.

3. The arm mounted transporting tray for food containers as defined in claim 2 wherein:

said longitudinal groove being centrally located relative to said upper surface.

4. The arm mounted transporting tray for food containers as defined in claim 1 wherein:

said graspable handle being located directly adjacent a fore end of said tray.

5. The arm mounted transporting tray for food containers as defined in claim 1 wherein:

said arm engagement comprising a clamping device, said clamping device being located directly adjacent an aft end of said tray.

6. The arm mounted transporting tray for food containers as defined in claim 5 wherein:

said clamping device being adjustable in order to accommodate to different sizes of user's forearms.

7. The arm mounted transporting tray for food containers as defined in claim 2 wherein:

said groove arrangement connecting to said opening.

8. The arm mounted transporting tray for food containers as defined in claim 1 wherein:

said arm engagement comprising a pair of spaced apart leg members with a user's forearm adapted to be confined therebetween.

9. The arm mounted transporting tray for food containers as defined in claim 8 wherein:

said leg members being identical and also identical to said graspable handle.

* * * * *